United States Patent [19]

Nakaoji et al.

[11] Patent Number: 4,500,041

[45] Date of Patent: Feb. 19, 1985

[54] PROCESS FOR PRODUCING HIGH-CONCENTRATION SLURRY OF COAL

[75] Inventors: Kazuhiko Nakaoji, Ichihara; Mitsugu Kamao, Chigasaki; Hayami Itoh, Himeji; Shuhei Tatsumi; Shoichi Takao, both of Akashi, all of Japan

[73] Assignees: Lion Corporation; Kao Corporation; Mitsui Engineering and Shipbuilding Company Limited; Electric Power Development Company Limited, all of Tokyo; Kawasaki Jukogyo Kabushiki Kaisha, Kobe, all of Japan

[21] Appl. No.: 446,604

[22] Filed: Dec. 3, 1982

[30] Foreign Application Priority Data

Dec. 3, 1981 [JP] Japan ..... 56-194776
May 27, 1982 [JP] Japan ..... 57-91088

[51] Int. Cl.[3] ..... B02C 19/12

[52] U.S. Cl. ..... 241/16; 241/21; 241/29; 241/97

[58] Field of Search ..... 241/81, 16, 21, 29, 241/24, 153, 170, 137, 1, 80, 97, 26, 284, 30; 44/1 B, 1 R, 51

[56] References Cited

U.S. PATENT DOCUMENTS

| | | | |
|---|---|---|---|
| 1,547,491 | 7/1925 | Barthelmess | 241/80 X |
| 3,715,083 | 2/1973 | Funk | 241/24 |
| 4,062,497 | 12/1977 | Kemp, Jr. et al. | 241/80 X |
| 4,162,045 | 7/1979 | Katzer et al. | 241/16 |
| 4,282,006 | 8/1981 | Funk | 44/51 |

*Primary Examiner*—Mark Rosenbaum
*Attorney, Agent, or Firm*—Wenderoth, Lind & Ponack

[57] ABSTRACT

High concentrated coal-water slurry is produced by coarsely crushing coal, thereafter pulverizing the coarsely crushed coal, together with water and a slurry dispersant, according to necessity, in a wet-type ball mill, and feeding back one portion of the finely pulverized coal slurry thus obtained into the inlet of the wet-type ball mill.

7 Claims, 7 Drawing Figures

PROCESS FOR PRODUCING HIGH-CONCENTRATION SLURRY OF COAL

BACKGROUND OF THE INVENTION

This invention relates to a process for producing a coal-water slurry of high concentration of coal by reducing the particle size of the coal (hereinafter referred to generally as "pulverizing" and sometimes as "crushing" or "grinding") in a specific manner.

The process of mixing pulverized coal with water and rendering the mixture into a high-concentration slurry which is of low viscosity whereby transfer thereof by pumping is possible, and which, moreover, has a fluidity such that the coal particles will not settle and separate out, in general, is difficult.

For this reason, measures such as the addition of additives for facilitating this process have heretofore been resorted to. At the same concentration of a coal-water slurry, a tendency of the slurry viscosity to increase with decrease in the coal particle size is exhibited. For this reason, the preparation of a high-concentration slurry for the purpose of direct combustion is difficult.

As a cumulative result of our research directed toward the objective of producing high-concentration slurries, we have discovered that, by finely pulverizing coal through a specific pulverizing step wherein the mixing time for preparation of coal slurry is prolonged, in the production of high-concentration coal-water slurry, thereby to obtain a specific particle-size constitution or distribution, it is possible to further increase the coal concentration of coal-water slurries having fluidity which have heretofore been obtained.

SUMMARY OF THE INVENTION

This invention, which has been developed on the basis of this discovery, seeks to provide a process for producing a high-concentration slurry of coal in water which, by increasing the concentration of a coal-water slurry, makes possible increase in the efficiency of slurry transportation, direct combustion of the coal-water slurry, and handling of coal as a fluid.

According to this invention, briefly summarized, there is provided a process for producing high-concentration coal-water slurry by pulverizing coal which process is characterized by the steps of first coarsely crushing coal, subjecting the coarsely crushed coal thus obtained, together with water and a slurry dispersant according to necessity, to a further pulverizing process step in a wet-type pulverizing machine thereby to obtain a finely pulverized coal slurry, and feeding back one portion of the slurry thus obtained to the inlet of the wet-type pulverizing machine.

The nature, utility, and further features of this invention will be more clearly apparent from the following detailed description, beginning with a consideration of general aspects of the invention and concluding with specific examples of practice thereof, when read in conjunction with the accompanying drawings, brief described below.

DETAILED DESCRIPTION OF THE INVENTION

Throughout the following description, quantities (amounts) expressed in percent (%) are by weight.

Figure 1:
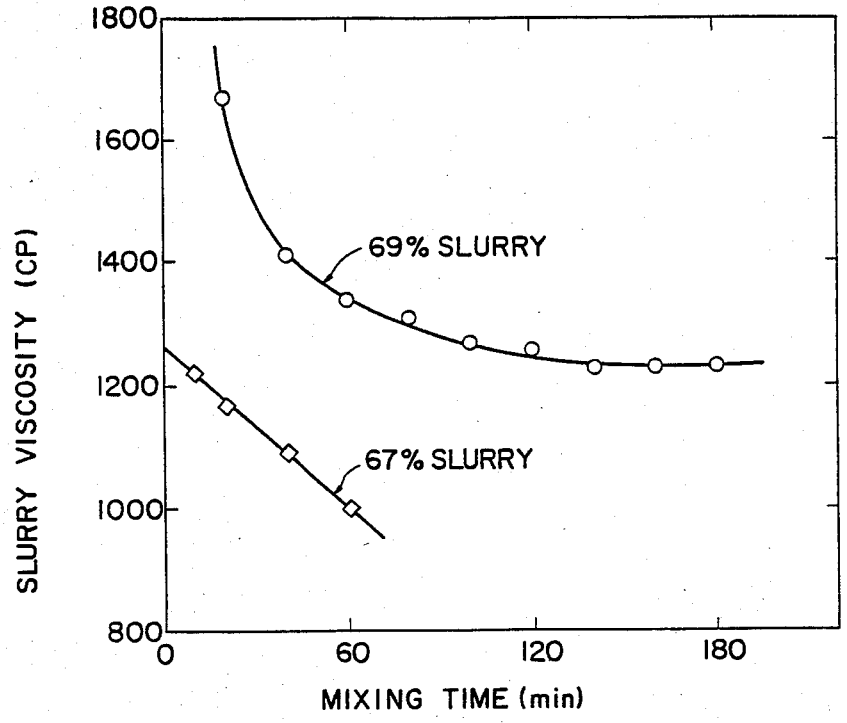
FIG. 1 is a graph indicating the relationship between mixing time of coal slurry and slurry viscosity (at 20° C.)

As mentioned hereinbefore, the outstanding feature of this invention resides in the prolonging of the slurry mixing time. The effectiveness of this measure was clearly demonstrated in an experiment we carried out as follows. Tatung coal as a specimen coal was pulverized so that 70 percent thereof was of 200-mesh size or smaller, and water and a slurry dispersant (1% relative to the coal) were added to prepare a 67% slurry and a 69% slurry, with which relationships between mixing time and slurry viscosity were measured. The results are indicated in FIG. 1, from which it is apparent that the slurry viscosity decreases with increase in the mixing time.

Figure 2:
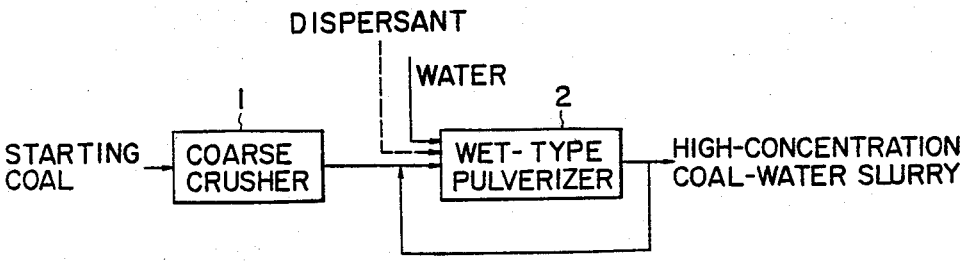
FIG. 2 is flow-chart process diagram indicating one example of the process of this invention.

In a first general example of the process of this invention as indicated in FIG. 2, the starting-material coal is coarsely crushed in a coarse crusher 1, and thereafter all of the coarsely crushed coal and water, together with a dispersant according to necessity, are introduced into and finely pulverized in a wet-type pulverizing machine 2 such as a wet-type ball mill. One portion (90 to 20%, preferably 80 to 40%, more preferably 80 to 60%) of the finely pulverized coal thus obtained is fed back into the inlet of the wet-type pulverizing machine 2 thereby to carry out fine pulverizing so as to obtain a specific particle size distribution or constitution, that is, up to 1% of 48-mesh and larger size, 20 to 30% of 200-mesh and larger size, and up to 80% of 350-mesh or smaller size. A high-concentration coal-water slurry having fluidity is thus prepared.

More specifically, a slurry is prepared by pulverizing to have a particle size constitution of up to 1% of 48-mesh and larger size, 20 to 30% of 200-mesh and larger size, 80 to 30% of 350-mesh and smaller size, and up to 40%, preferably up to 30% of 200- to 350-mesh size. A slurry of a particle size constitution of 20 to 30% of 200-mesh and larger size, 80 to 70% of 350-mesh and smaller size, and up to 10% of 200- to 350-mesh size can also be prepared.

Figure 3:
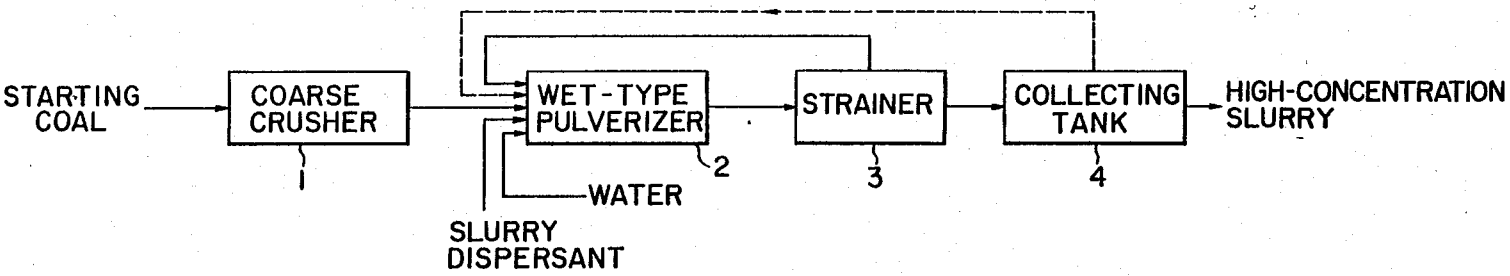
FIG. 3 is a flow-chart process diagram indicating another example of the process of the invention.

In another example of the process according to this invention as indicated in FIG. 3, the starting-material coal is coarsely crushed in a coarse crusher 1, and thereafter the coarsely crushed coal thus obtained, together with water and a slurry dispersant, is continuously introduced into and finely pulverized in a wet-type pulverizing machine 2 such as a wet-type ball mill. The resulting slurry discharged from the wet-type pulverizing machine 2 is passed through a strainer 3 to be divided into slurry containing coarse particles and slurry not containing coarse particles.

The former slurry containing coarse particles is fed back into the inlet of the wet-type pulverizing machine 2 thereby to prepare a high-concentration slurry of coal of a particle size constitution ordinarily of up to 1% of 48-mesh and larger size, 10 to 50% of 200-mesh and larger size, 10 to 70% of 350-mesh and smaller size, up to 40%, preferably up to 30% of 200- to 350-mesh size. The quantity per unit time or flow rate of the recirculated slurry fed back to the inlet of the pulverizing machine 2 is so regulated that the ratio thereof to the flow rate of the supplied slurry will be 0.01 to 3, preferably 0.2 to 2. Here, the flow rate of the supplied slurry means the sum of the gravimetric flow rates of the coarsely crushed coal from the coarse crusher 1 and of the added water and slurry dispersant, according to necessity. The flow rate of the slurry dispersant if added is 0.01 to 3 percent, preferably 0.3 to 1.5 percent relative to that of the coal.

The above mentioned slurry not containing coarse particles which is discharged from the strainer, according to necessity, is transferred into a collecting tank 4 where it is agitated and can be further stabilized. Furthermore, one portion of the high-concentration coal slurry from the collecting tank 4 may also be fed back into the inlet of the pulverizing machine 2.

A dispersant to be used in the process of this invention comprises at least one surface active agent or surfactant suitably selected from anionic, nonionic, and cationic surfactants, used singly or in combination, depending on the kind of coal.

Specific examples of such anionic surfactants are fatty oil sulfate, higher alcohol sulfate, nonionic ether sulfate, olefin sulfate, alkyl allyl sulfonate, dicarboxylate sulfate, dialkyl sulfo succinate, acyl sarcosinate, alkyl benzene sulfonate, alkyl sulfate, polyoxyethylene alkyl (alkyl phenol) sulfate, alkyl phosphate, salts of esters of dialkyl sulfo succinic acid, acrylic acid and/or maleic anhydride copolymer, polycyclic aromatic sulfonate, formalin compounds.

Specific examples of cationic surfactants are salts of alkyl amines and salts of quaternary amines, alkyltrimethyl ammonium chloride, alkyl dimethyl benzyl ammonium chloride and salts of alkylpyridium.

Specific examples of nonionic surfactants are polyoxyalkyl ether, polyoxyethylene alkyl phenol ether, oxyethylene.oxypropylene blockpolymer, polyoxyethylene alkyl amine, sorbitan fatty acid ester, polyoxyethylene solbitan fatty acid ester, polyoxyethylene fatty acid ester, fatty alcohol polyoxyethylene ether, alkyl phenol polyoxyethylene ether, polyhydric alcohol fatty acid ester, ethanolamide fatty acid.

As amphoteric surfactants, alkyl betaine and the like as well as amine compounds such as 1,2,3-monoamines and diamines and higher alkylamino acids and the like are used. The quantity of the dispersant to be added is 0.01 to 3 percent, preferably 0.3 to 1.5 percent relative to that of the coal.

In order to indicate more fully the nature and utility of this invention, the following specific examples of practice thereof are set forth, it being understood that these examples are presented as illustrative only and are not intended to limit the scope of the invention.

EXAMPLE 1

Starting-material coal for testing of the properties set forth in the following Table 1 was coarsely crushed to particle sizes of approximately 4 mm and smaller (30% of 1 mm and larger, 10% of 2 mm and larger, and 1% of 4 mm and larger) in a coarse crusher, and thereafter the coarsely crushed coal, together with 1% relative to the coal of a dispersant, was fed into and finely pulverized in a wet-type ball mill. 50 percent of the slurry thus finely pulverized was recirculated into the wet-type ball mill and finely pulverized into particles of 48-mesh and smaller size thereby to prepare a high-concentration coal-water slurry.

This slurry had a solid concentration of 70 percent, a viscosity of 1,000 cp (at 25° C.), and a particle size constitution comprising 25% of 200-mesh and larger size, 5% of 200- to 350-mesh size, and 70% of 350-mesh and smaller size.

TABLE 1

| Properties of starting coal for testing | |
|---|---|
| Moisture content | 7.2% |
| Ash content | 3.9% |
| Volatile matter content | 28.2% |
| Fixed carbon | 60.0% |
| Fuel ratio | 2.13 |
| Elementary analysis | |
| C | 77.9% |
| H | 4.5% |
| O | 7.0% |
| N | 0.9% |
| S | 0.7% |
| Calorific value | 7,450 Kcal/kg |

Figure 4:
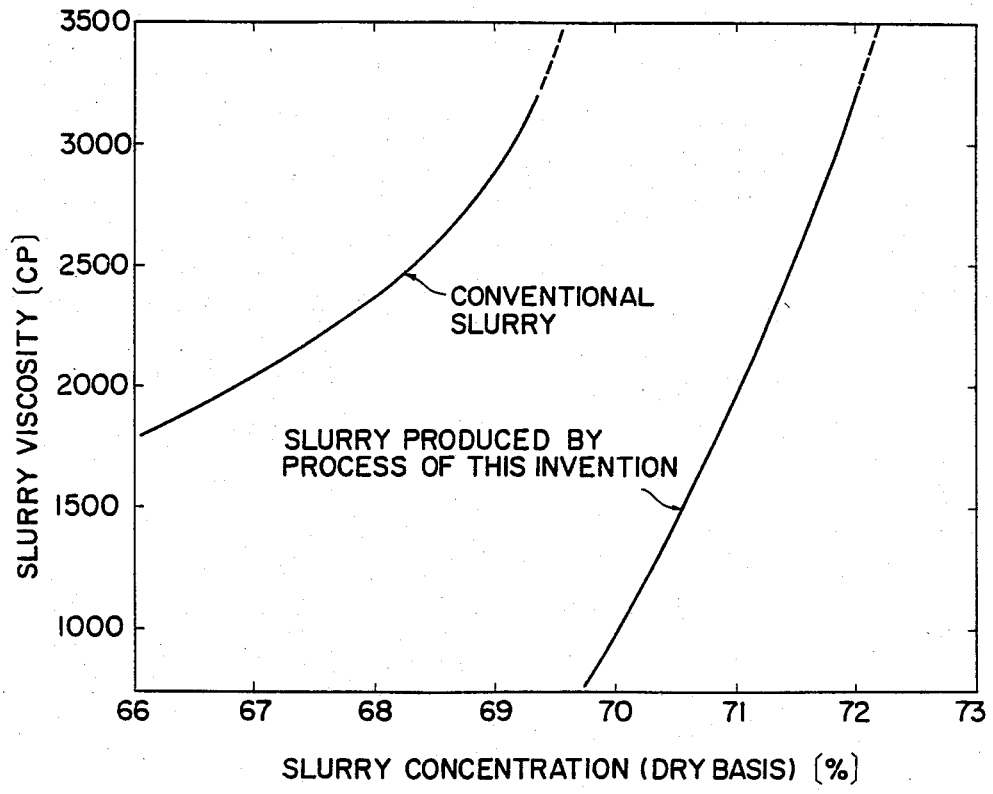
FIG. 4 is a graph indicating the relationships between slurry concentration and slurry viscosity respectively of a slurry obtained by the process of this invention and of a slurry of the prior art.

The effectiveness of the process of this invention is indicated in FIG. 4, which is a graph, based on actual test measurements, showing the relationships between slurry concentration and slurry viscosity (at 25° C.) for a coal-water slurry prepared by a conventional process and that prepared by the process of this invention. It is apparent from FIG. 4 that; at a slurry viscosity of 2,000 cp, for example, the coal concentration of the conventionally prepared slurry is approximately 67%, while the coal concentration of the slurry prepared by the process of this invention is approximately 71%, which is approximately 4% higher than the former concentration.

Figure 5:
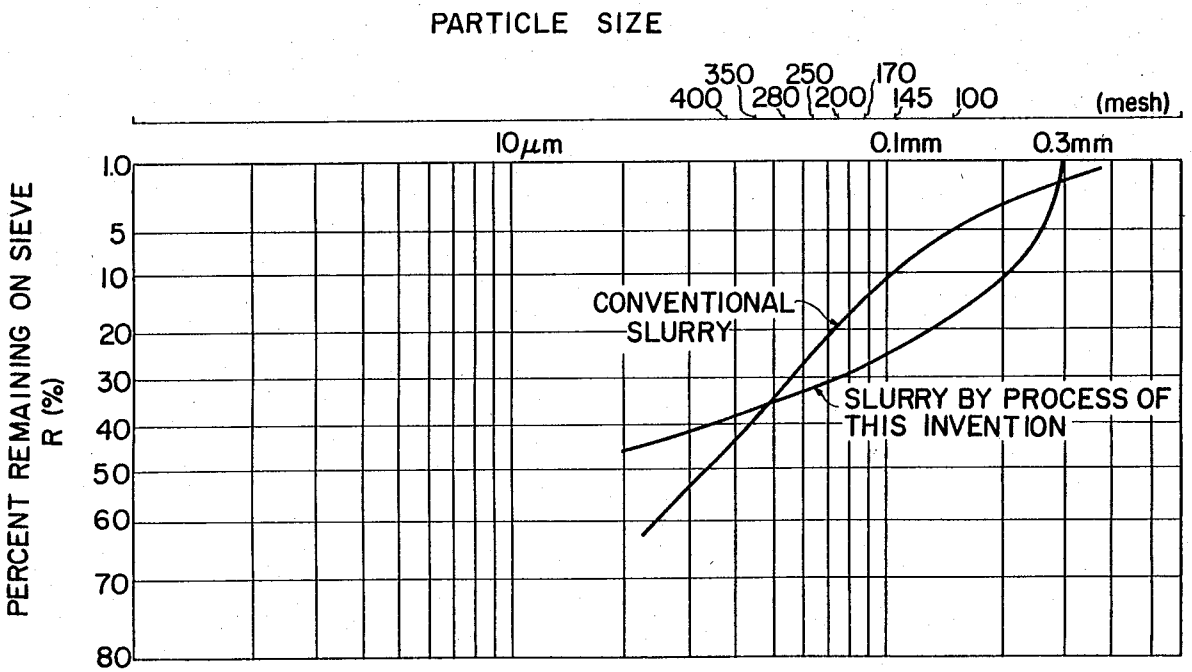
FIG. 5 is a logarithmic graph indicating particle size constitutions of a slurry obtained by the process of this invention and of a slurry of the prior art.

Furthermore, the particle size constitutions of the conventional slurry and of the slurry prepared by the process of this invention, also based on actual test measurements, are comparatively shown in FIG. 5. In this case, 1% of a dispersant was added to each of these slurries. It is apparent from FIG. 5 that the 200- and 350-mesh fraction is of a great amount in the conventional slurry, whereas it is of relatively small amount in the slurry prepared by the process of this invention.

A particle size constitution of this nature can be readily obtained by processing coal in accordance with the process of this invention.

EXAMPLE 2

Figure 6:
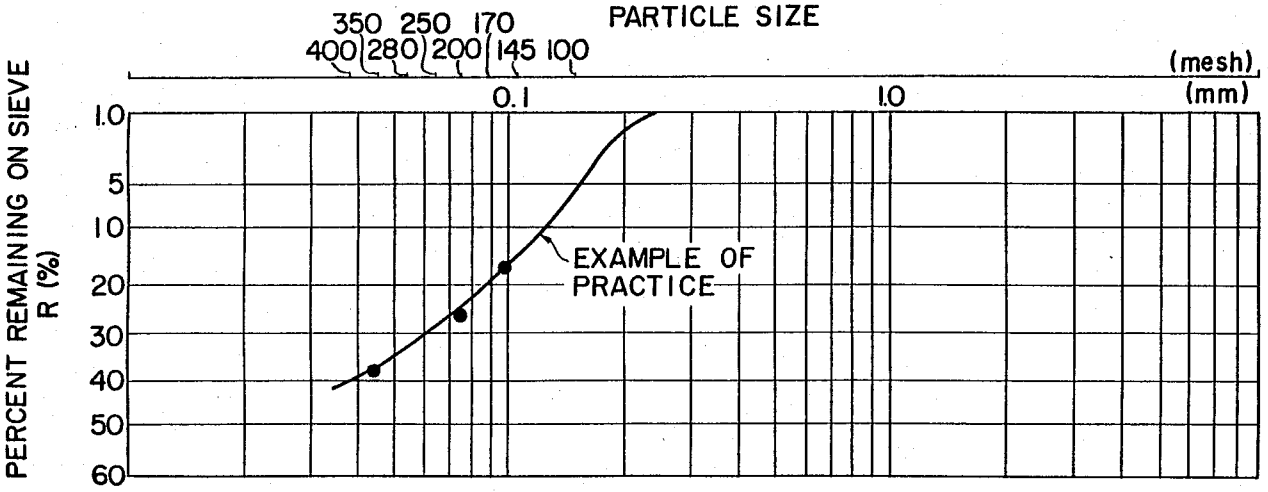
FIG. 6 is a graph similar to FIG. 5 indicating the particle size constitution of slurry obtained in an example of practice of the invention.

Starting-material coal for testing of the properties set forth in the following Table 2 was coarsely crushed in a coarse crusher to particle sizes of approximately 4 mm and smaller (30% of 1 mm and larger size, 10% of 2 mm and larger, and 1% or less of 4 mm and larger). Thereafter water and an anionic dispersant (1% relative to the coal) were added, and the resulting mixture was adjusted to a coal concentration of 68% and then continuously fed as a slurry at a rate of 5 kg/hr into a wet-type ball mill, where it was finely pulverized so that the fraction of 200-mesh or small size became 70%. Then the slurry discharged from the outlet of the wet-type ball mill was divided in a strainer into a slurry containing coarse particles of 0.5 mm and larger size and a slurry not containing coarse particles of 0.5 mm and larger size. All of the former slurry and one portion of the latter slurry were combined and fed back at 5 kg/hr (as a slurry) into the inlet of the wet-type ball mill. The remainder was taken out as a product slurry. The product slurry at this time had a concentration of 68 percent, a viscosity of 700 cp (at 20° C.), and a particle size constitution comprising 0.8% of 48-mesh and larger size, 26% of 200-mesh and larger size, and 62% of 350-mesh and smaller size. The particle size distribution of this product slurry was as indicated in FIG. 6.

TABLE 2

| Properties of starting coal for testing | |
|---|---|
| Moisture content | 7.2% |
| Ash content | 8.9% |
| Volatile matter content | 28.2% |
| Calorifie value | 7,450 kcal/kg |
| True specific gravity | 1.45 |
| C | 77.9% |
| H | 4.5% |
| O | 7.0% |
| N | 0.9% |
| S | 0.7% |

Figure 7:
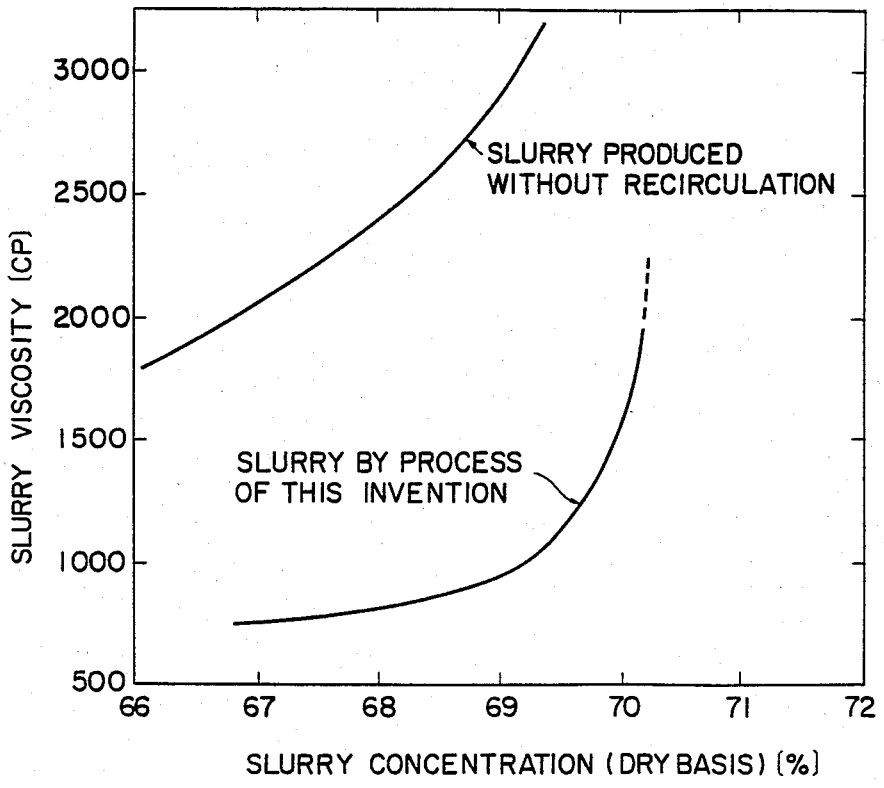
FIG. 7 is a graph indicating relationships between slurry concentration and viscosity of a slurry obtained by the process of this invention and of a slurry obtained without a slurry feed-back step.

The relationships between concentration and viscosity (at 20° C.) of a first slurry produced without a slurry feed-back step and the slurry obtained by the process of this invention in the example of practice (slurry obtained by the recirculation method) are indicated in FIG. 7. It is apparent from FIG. 7 that, at a slurry viscosity of 2,000 cp, for example, the coal concentration of the first slurry is approximately 66.8 percent, while that of the slurry obtained by the process of this invention is approximately 70.2 percent, and that, by the process of the invention, the coal concentration is increased by approximately 3.4 percent.

Thus, the process of this invention comprises coarsely crushing coal, then further pulverizing the coarsely crushed coal thus obtained, together with water and a slurry dispersant, depending on the necessity, in a wet-type pulverizing machine, and feeding back one portion of the finely pulverized coal slurry thus obtained into the wet-type pulverizing machine. By this process, the coal particle size distribution is caused to have a relatively small fraction between 200-mesh and 350-mesh sizes.

At the same time, by lengthening the mixing time, the mixed state of the slurry is improved, and the maximum limiting concentration of the high-concentration slurry can be increased by a number of percent over the concentrations attained heretofore. As a result, improvement of the efficiency of coal slurry transportation, direct combustion of coal slurry, and handling of coal as a fluid become possible.

Furthermore, by using a wet-type pulverizing machine such as a wet-type ball mill, the coal can be finely pulverized, and, at the same time, the coal, water, and a dispersant can be uniformly mixed, whereby various advantages such as the possibility of eliminating a mixing preparatory step of coal-water slurry are derived.

What we claim is:

1. A process for producing high-concentration coal-water slurry by pulverizing coal consisting essentially of first coarsely crushing the coal, thereafter subjecting the coarsely crushed coal thus obtained to a pulverizing process, together with water, in a wet-type pulverizing machine, and feeding back one portion of the finely pulverized coal slurry thus obtained into the inlet of said wet-type pulverizing machine.

2. The process according to claim 1 in which said one portion of said finely pulverized coal slurry is 90 to 20 percent by weight.

3. The process according to claim 2 in which the coal particles in the final coal slurry has a particle size constitution comprising 20 to 30% by weight of 200-mesh and larger size and up to 80% by weight of 350-mesh and smaller size.

4. The process according to claim 2 in which the coal particles in the final coal slurry have a particle size constitution comprising up to 1% by weight of 48-mesh and larger size, 20 to 30% by weight of 200-mesh and larger size, up to 80% by weight of 350-mesh and smaller size, and up to 40% by weight of 200- to 350-mesh size.

5. The process according to claim 1 in which a slurry dispersant is added to the pulverizing process.

6. The process according to claim 5 in which the slurry dispersant comprises at least one surface active agent suitably selected from anionic, nonionic, and cationic surface active agents.

7. The process according to claim 5 in which the slurry dispersant is used in a quantity of 0.01 to 3 percent by weight relative to the coal.

* * * * *